United States Patent [19]

Tanca

[11] Patent Number: 4,680,035

[45] Date of Patent: Jul. 14, 1987

[54] TWO STAGE SLAGGING GASIFIER

[75] Inventor: Michael C. Tanca, Tariffville, Conn.

[73] Assignee: Combustion Engineering, Inc., Windsor, Conn.

[21] Appl. No.: 845,164

[22] Filed: Mar. 27, 1986

[51] Int. Cl.[4] ..... C10J 3/48

[52] U.S. Cl. ..... 48/77; 48/63; 48/67; 48/69; 48/DIG. 2

[58] Field of Search ..... 48/63, 64, 67, 69, 73, 48/76, 77, DIG. 2; 110/347, 229; 122/6 A, 7 R

[56] References Cited

U.S. PATENT DOCUMENTS

| | | | |
|---|---|---|---|
| 2,644,745 | 7/1953 | Hemminger | 48/63 |
| 3,864,100 | 2/1975 | Blaskowski | 48/73 |
| 4,393,627 | 8/1982 | Tanca | 48/202 |
| 4,602,573 | 7/1986 | Tanca | 110/342 |

*Primary Examiner*—Peter Kratz

*Attorney, Agent, or Firm*—Arthur E. Fournier, Jr.

[57] ABSTRACT

An entrained flow coal gasifier having a combustor zone (16) and a reductor zone (18) separated by a centrally located baffle (14). The baffle (14) covers the projected plan area of a slag tap (44) whereby cool slag falling from the reductor (18) will be heated before flowing through the slag tap.

3 Claims, 6 Drawing Figures

TWO STAGE SLAGGING GASIFIER

BACKGROUND OF THE INVENTION

The invention relates to coal gasifiers and in particular to entrained flow slagging type gasifiers.

Entrained flow coal gasifiers which are illustrated in U.S. Pat. No. 4,343,627 issued to Michael C. Tanca on Aug. 10, 1982 operate by injecting a carbonaceous material (including recycled char) into the lower portion of the gasifier along with an air supply. Combustion in this portion of the gasifier supplies heat for the gasification reaction and should be maintained at such a temperature level as to permit the liquid ash or slag to flow out through a slag tap opening at the bottom. This portion of the gasifier is generally termed the combustion zone or combustor, and is operated at near stoichiometric conditions to obtain the maximum heat and maximum temperature to facilitate the removal of the slag.

These combustion products are conveyed upwardly to a reduction zone, or reductor where additional fuel in the form of carbonaceous material including pulverized coal is added. This additional fuel is devolatized with the remaining carbon residue, termed char, reacting with the combustion products of the reduction zone to form a combustible gas which is largely carbon monoxide. The gasification reaction is an endothermic reaction obtaining its heat from the combustion products formed in the combustion zone. This gasification process continues until the temperature level of about 1700° F. is reached at which the gasification rate is too slow for practical purposes. Any remaining char particles are removed and recycled either to the combustion zone or the reduction zone.

The maximum obtainable temperature is desired in the combustion zone for the purpose of facilitating combustion of the solid carbon particles and for maintaining the slag as fluid as possible so that it will flow freely. Radiation from the combustion zone to the reduction zone tends to decrease the temperature in the combustion zone. Accordingly, it has been known to neck down the gasifier between the combustion zone and reduction zone by bending the walls of the gasifier inwardly to form a relatively narrow opening, in the order of 50 percent of the overall flow area of the gasifier. This construction leads to very expensive fabrication problems in bending and spacing the tubes as well as finning the spacing as it varies along the length of the tubes. It furthermore leads to several potential operating problems.

With centrifugal action within the gasifier caused by tangential injection of the fuel a low pressure core exists. There is a tendency for gas from the reduction zone to be drawn down through this core into the combustion zone section. This not only causes an unwanted cooling of the combustor but also draws down the desired end product, combustible gas, where it may be burned in preference to the carbonaceous material which is intended to be burned in the combustion zone.

Slag forming in the reduction section passes down along the walls, and with the centrally located opening drops to a location extremely close to the slag tap opening. Because of the lower temperature in the reductor the slag is relatively cool and accordingly does not flow freely. Dropping of this slag near the edge of the slag tap opening therefore tends to promote plugging of the opening.

It is accordingly desirable to have the two stage gasifier where radiation between the combustor and reductor is minimized, wherein gas is not drawn back from the reductor into the combustor, and where slag dropping from the reductor will fall to an outboard location within the combustor so that it has time to be heated and flow freely before it reaches the slag tap opening.

SUMMARY OF THE INVENTION

A two stage coal gasifier has a vertically elongated gasifier chamber for upward flow of the gas to an opening at the top. Tubes forming the walls of the chamber form a centrally located slag tap opening at the bottom of the chamber. In the lower portion of the gasifier is a combustor section where fuel injection nozzles inject coal tangentially along with combustion supporting air to supply the heat source. At an upper elevation is a reductor section wherein additional fuel is introduced for the purpose of gasifying this additional fuel. Between the combustor section and the reductor section there is a centrally located baffle. This baffle is larger in plan area than the tap opening and arranged so that any slag falling around the baffle will land some distance remote from the slag tap opening.

The centrally located baffle minimizes the radiation loss from the combustor to the reductor, blocks the central portion of the gasifier chamber so that gas is not drawn back down from the reductor section, and forces the slag falling from the reductor to enter the combustor at a location outboard of the slag tap opening so that it has time to be heated substantially before passing to the slag tap opening.

DESCRIPTION OF THE PREFERRED EMBODIMENT

Figure 1:
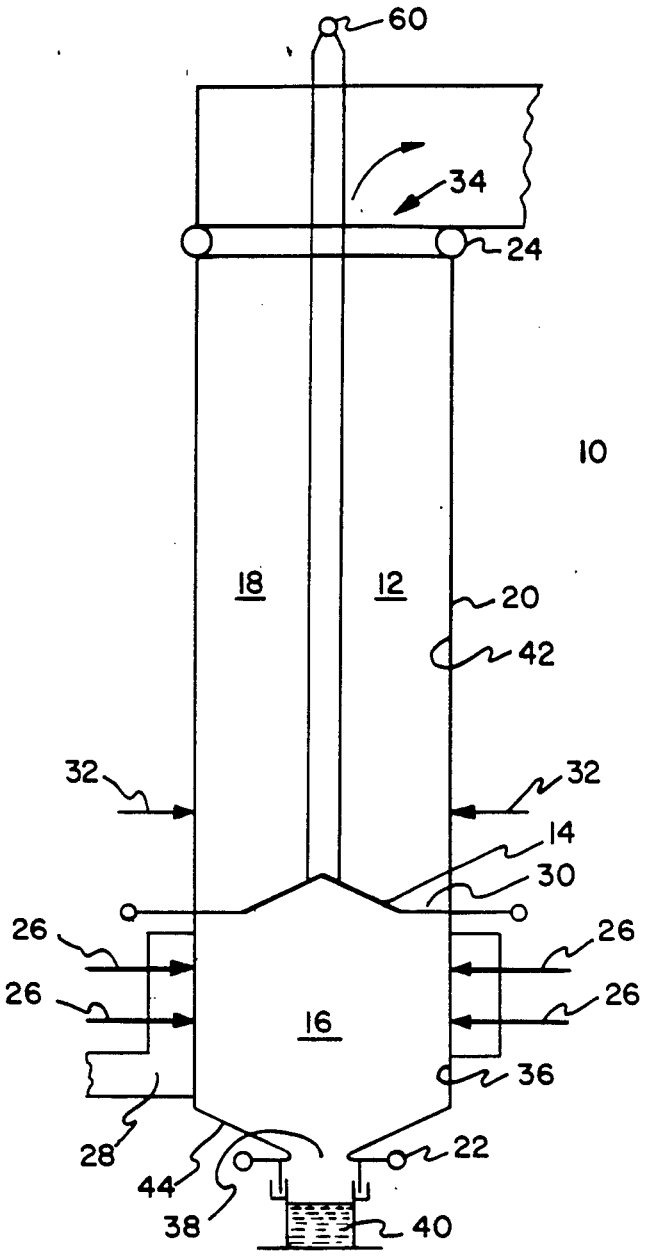
FIG. 1 is a schematic side elevation of the gasifier.

A two stage coal gasifier 10 has a furnace chamber 12 which is divided by baffle 14 into a combustor 16 and a reductor 18. The combustor 12 is substantially circular in shape and is defined by a plurality of vertical steam generating tubes 20 which are supplied with water from header 22 discharging the steam boiler mixture in header 24 from which it is passed to a steam drum (not shown) for collection of the steam and recycle of the water.

Fuel in the form of a carbonaceous material which may be recycled char or pulverized coal is fed through combustor fuel injection nozzles 26 into the combustor 16 directed tangent to an imaginary circle within the combustor 16. Combustion supporting air is supplied through windbox 28. Although air is most frequently used as the combustor oxidant, oxygen-enriched air or pure oxygen may be used. The combustor is operated at near stoichiometric conditions in that the air supplied is close to that required for theoretical complete combustion. This results in a maximum temperature within the combustor 16.

These combustion gases pass upwardly through annular space 30 around baffle 14 into the reductor section 18. At the lower end of the reductor additional fuel in the form of carbonaceous material including pulverized coal is injected through fuel injection nozzles 32. This coal is devolatized and gasified while undergoing an endothermic reaction to form a combustible product gas. This product gas passes upwardly and out through opening 34 at a temperature of about 1700° F.

Within the combustor 16 the ash in the coal is heated to form a molten slag which collects predominantly on the inner surface 36 of the walls of the combustor. With the combustor operating at a temperature in the order of 3000° F. the slag is relatively fluid and flows down the walls across the bottom, through the slag tap 38, and into a water quench hopper 40. It is important that this slag be maintained at a high temperature since it becomes viscous at a lower temperature which causes a slag buildup and subsequent pluggage to occur within the slag tap 38.

Some of the ash from the combustor is carried up into the reductor and additional ash is introduced with the fuel from the fuel injection nozzles 32. While some slag drops on top of baffle 14 the majority is collected on the inner surface 42 of walls 20. This slag is much more viscous but will work its way down the walls into the combustor 16. On occasion, there may be a slight buildup on the wall with chunks of solid slag also dropping down.

With the baffle 14 centrally located any slag passing down from the reductor section must pass down at an outboard location with respect to the center of the gasifier so that it drops or works its way down to the floor 44 at an outboard location remote from the slag tap opening 38. Accordingly, this slag will have ample opportunity to be heated to a temperature where it is less viscous so that it may freely flow through the slag tap opening 38.

Both the fuel injection nozzles 26 in the combustor and the fuel injection nozzles 32 in the reductor are fired tangential to imaginary circles within the gasifier to promote mixing. A baffle 14 blocks the central core wherein there could be a tendency for the gas from the reductor 18 to be drawn down into the combustor 16.

The baffle 14 also operates to block radiation from the combustor 16 to the reductor 18 thereby maximizing the temperature within the combustor.

Figure 2:
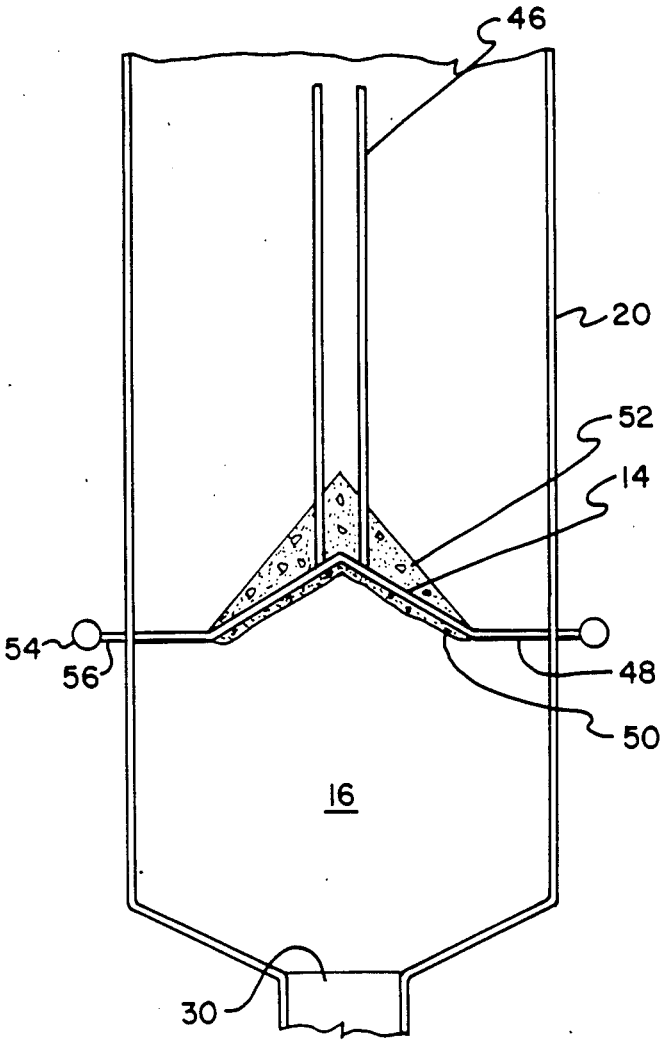
FIG. 2 is a side elevation showing an arrangement of the centrally located baffle within the gasifier chamber.

FIG. 2 illustrates the baffle 14 supported by hanger tubes 46 and braced by four screen and support tubes 48 within the gasifier chamber. The tubes of the baffle 14 are preferably studded and coated with a refractory material shown by the layer of refractory 50 on the bottom side of the baffle, and a layer of refractory 52 such as silicon carbide on the upper side of the baffle. On the top side of the baffle the refractory may be built up as illustrated to improve the gas flow pattern and to minimize collection of particulate matter on the baffle. This baffle is lined with refractory since its purpose is not to absorb heat but to only baffle the gases and the water cooling is only required because of the high temperature environment in which it must operate.

Figure 4:
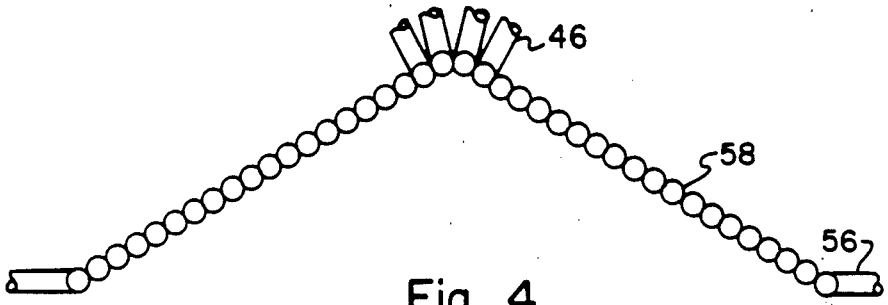
FIG. 4 is a sectional elevation through the baffle.
Figure 3:
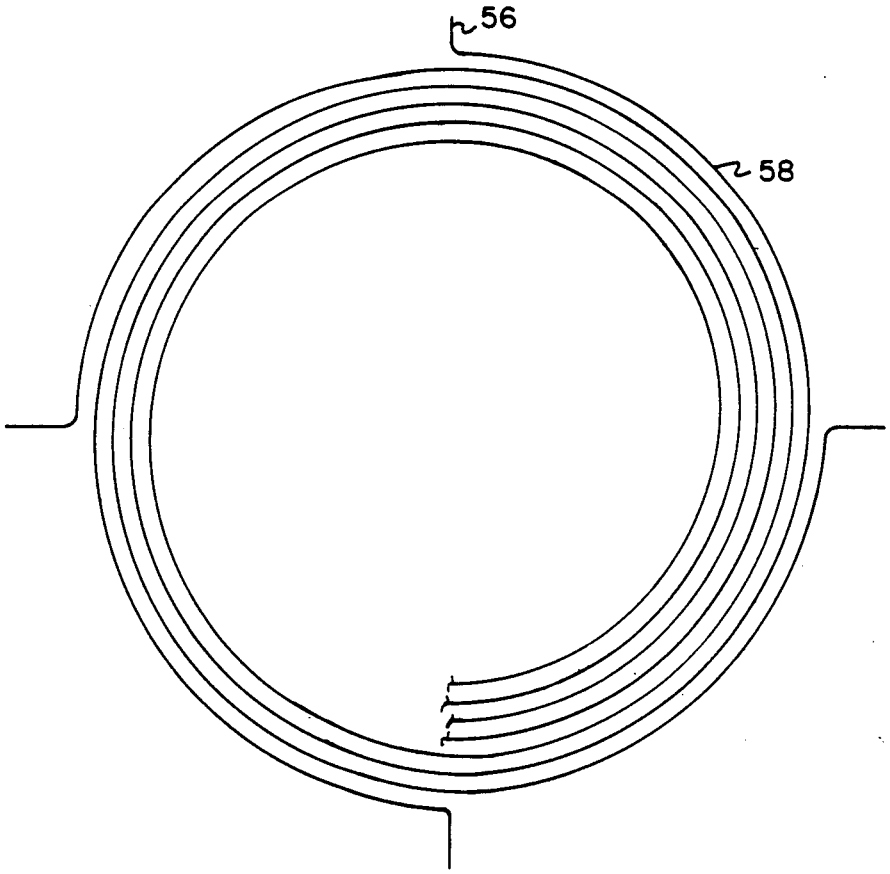
FIG. 3 is a plan view of the baffle.

Water cooling for the baffle is obtained by water supplied from headers 54 passing through inlet tubes 56 into the pancake coils 58 as illustrated in FIGS. 3 and 4. Water after passing through the pancake coils passes upwardly through hanger tubes 46 to the upper header 60. The water steam mixture is passed through a steam drum for the separation of any steam that is formed, with the water being returned. The continuous upward path of the circuit eliminates the possibility of steam binding during operation.

Figure 6:
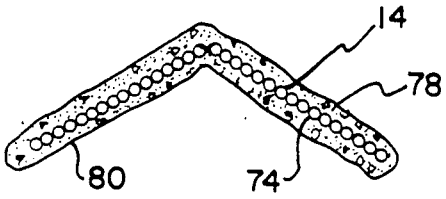
FIG. 6 is a sectional view through the baffle of FIG. 5.
Figure 5:
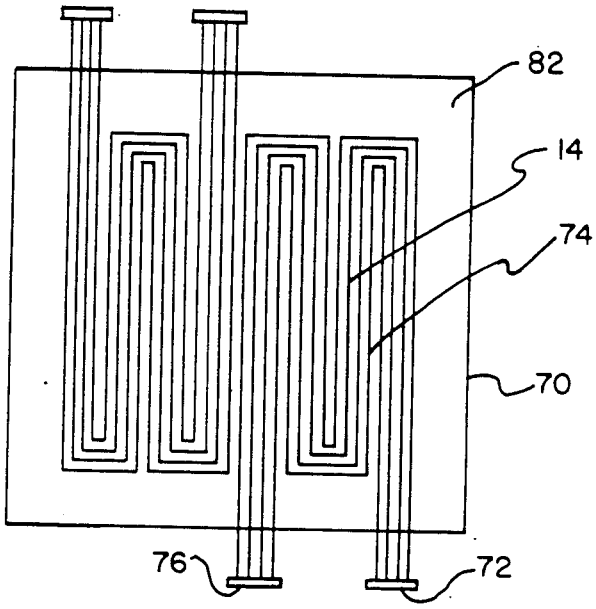
FIG. 5 is a plan view of a baffle for use in a square gasifier.

FIGS. 5 and 6 illustrate an alternate embodiment of the baffle for use in a square gasifier. The baffle 14 is located within a square gasifier 70. Cooling water for the baffle flows from inlet heater 72 through the serpentine coils 74 to outlet header 76. This baffle is also covered by a layer of refractory 78 on the upper surface and a layer of refractory 80 on the lower surface. The baffle is in the shape of a chevron in one section only, with a flow opening 82 for gases being located around the periphery of the baffle 14.

The upward flow at the exit of the gasifier is at the rate of 20 to 30 feet per second with the gas temperature at 1700° F. With the baffle 14 covering half of the flow area of the gasifier the velocity through the opening is in the order of 100 to 150 feet per second, this being a great deal higher because of the temperature in the order of 3000° F. of the gases. It is desired that the baffle cover as much of the opening as possible for example, greater than 50 percent of the plan area of the gasification chamber may be covered for the purpose of blocking radiation from the combustor. It is limited by the erosion effect of the high velocity gases and accordingly approximately 50 percent of the opening being blocked by the baffle is the practical amount.

It is also noted that the plan area of the baffle exceeds the plan area of the slag tap and that it is directly located over the projected area of the opening in the slag tap. It extends substantially beyond the slag tap such that any slag dripping off the edge of the baffle will fall at a location sufficiently remote from the slag tap to be heated to a temperature where its viscosity is low before it flows into the slag tap, thereby minimizing possibilities of pluggage of the slag tap. The gasifier of my invention minimizes the possibility of backmixing of the low temperature reductor gas into the combustor, provides shielding to avoid cooling of the combustor by radiation, and facilitates maintenance of fluid slag in the area of the slag tap during operation of the gasifier.

I claim:

1. In a two stage coal gasifier having an elongated gasifier chamber through which gas is made to flow, said elongated gasifier chamber being defined by a plurality of elongated members interconnected so as to extend in parallel relation one to another, said elongated gasifier chamber having an opening formed adjacent one end thereof through which the gas after flowing through said elongated gasifier chamber exits from the two stage coal gasifier and having a centrally located slag tap opening formed at the other end thereof through which the slag formed in the two stage coal gasifier exits therefrom, combustor fuel injection means located at a first elevation within said elongated gasifier chamber operative for injecting carbonaceous material therewithin, reductor fuel injection means located at a second elevation within said elongated gasifier chamber operative for injecting carbonaceous material therewithin, the improvement comprising baffle means mounted within said elongated gasifier chamber at a third elevation located between said combustor fuel injection means and said reductor fuel injection means, said baffle means being operative to divide said elongated gasifier chamber into a combustor section and a reductor section, said combustor section extending between said baffle means and said centrally located slag tap opening, said reductor section extending between said baffle means and said opening through which gas exits from the two stage coal gasifier, said baffle means being operative to block off greater than fifty percent of the plan area of said elongated gasifier chamber so as to thereby block radiation from occurring from said combustor section to said reductor section as well as to thereby minimize the possibility of the gas in said reductor section backmixing with the gas in said combustor section, said baffle means having a plan area substantially larger than the plan area of said centrally located slag tap opening so as to thereby cause the slag dropping past said baffle means to fall at a location remote from the location of said centrally located slag tap opening, said baffle means including a plurality of water cooled tubes arranged so as to embody the shape of an inverted Vee with the point of the Vee projecting towards said reductor section, said plurality of water cooled tubes having refractory material secured thereto on the outer surfaces thereof, said baffle means further including first means connected in fluid flow relation to said plurality of water cooled tubes for conveying water thereto and second means connected in fluid flow relation to said plurality of water cooled tubes for conveying water therefrom.

2. In a two stage coal gasifier as set forth in claim 1 wherein both said elongated gasifier chamber and said baffle means each have a substantially circular plan area.

3. In a two stage coal gasifier as set forth in claim 1 wherein both said elongated gasifier chamber and said baffle means each have a substantially rectangular plan area.

* * * * *